US006154556A

United States Patent [19]

Takahashi et al.

[11] Patent Number: 6,154,556

[45] Date of Patent: Nov. 28, 2000

[54] DOME SPEAKER

[75] Inventors: Osamu Takahashi; Kunio Mitobe, both of Yamagata-ken, Japan

[73] Assignees: Pioneer Electronic Corporation, Tokyo, Japan; Tohoku Pioneer Electronic Corporation, Yamagata-ken, Japan

[21] Appl. No.: 09/184,241

[22] Filed: Nov. 2, 1998

[30] Foreign Application Priority Data

Nov. 10, 1997 [JP] Japan ..... 9-323796

[51] Int. Cl.[7] ..... H04R 25/00

[52] U.S. Cl. ..... 381/430; 381/353; 381/407

[58] Field of Search ..... 381/423, 424, 381/426, 430, 396, 398, 353, 354, 189, FOR 162, 407; 181/166, 167

[56] References Cited

U.S. PATENT DOCUMENTS 4,433,214 2/1984 Jasinski ..... 381/430

5,157,731 10/1992 Mitobe ..... 381/430

*Primary Examiner*—Huyen Le

*Attorney, Agent, or Firm*—Arent Fox Kintner Plotkin & Kahn, PLLC

[57] ABSTRACT

A dome speaker comprises a dome section including a vibrating diaphragm having a dome shape, an annular edge damper section provided surrounding the dome section, an annular coil holder provided between the dome section and the annular edge damper section for holding a voice coil. In particular, the dome section further includes a cap having substantially the same shape as the vibrating diaphragm, said cap being bonded on the said vibrating diaphragm.

8 Claims, 7 Drawing Sheets

DOME SPEAKER

BACKGROUND OF THE INVENTION

The present invention relates to a speaker and a method for manufacturing the same, in particular to a dome speaker having a dome-shaped vibrating diaphragm and a method for manufacturing the same.

It is known that a speaker for use in an audio system is usually a converter capable of converting an electric signal (an electric energy from an amplifier) to an audio signal (a sound energy).

According to operational principles, commercially available speakers may be classified into a dynamic speaker, an electro static speaker, a piezoelectric speaker, an ionic speaker (ionophone), a magnetic speaker. In fact, the dynamic speaker is a most widely used type because of its good sound quality and some other advantages.

In detail, a dynamic speaker further includes a cone speaker and a dome speaker, both of which are capable of vibrating their vibrating diaphragms by virtue of voice coils provided in their magnetic circuits. But, there is a difference between these two types of speakers. In a cone speaker, its voice coil is driven at a cone neck of a conic vibrating diaphragm. In a dome speaker, since its vibrating diaphragm has a generally dome shape, its voice coil is driven on the outside of the circumference of a dome-shaped diaphragm.

However, in a dome speaker, since its voice coil has a diameter which is almost the same as that of its vibrating diaphragm, the vibrating diaphragm is difficult to be made large in its diameter. On the other hand, since a dome speaker is driven by a voice coil having almost the same diameter as that of a vibrating diaphragm, a relatively large driving force may be obtained for the speaker even if the vibrating diaphragm has a relatively small diameter. For this reason, a dome speaker is often used as a high frequency speaker having a small diameter vibrating diaphragm or a low frequency speaker having a small diameter vibrating diaphragm in a multi-speaker system. Further, it may be used as a receiver in a portable telephone for which a compact size is required.

Usually, a vibrating diaphragm of a dome speaker has a coil holder which is integrally formed with an edge damper that is provided for elastically supporting the vibrating diaphragm. Such a coil holder is proved to be useful for improving an operational efficiency when assembling a speaker device, ensuring that each element may be located at a predetermined position in the assembled speaker with a high precision.

FIG. 6 is a cross sectional view schematically indicating a structure of a dome speaker which employs the above mentioned vibrating diaphragm. As shown in FIG. 6, the dome speaker includes a yoke 101 having a pole section 101*a*, a ring-shaped magnet 102, a plate 103, thus forming a magnetic circuit having an annular magnetic gap. Further, a generally spherical dome-shaped vibrating diaphragm 104 is provided above the pole section 101*a* of the yoke 101.

FIG. 7 is an enlarged cross sectional view partially indicating the speaker of FIG. 6, illustrating an area close to the outer edge of the dome-shaped vibrating diaphragm 104. As shown in FIG. 7, along the outer edge of the vibrating diaphragm 104 is formed an annular coil holder 105 having a U-shaped cross section. Connected with the annular coil holder 105 on its outer edge is an annular edge damper 106. In practice, the dome-shaped vibrating diaphragm 104, the annular coil holder 105 and the annular edge damper 106 are integrally formed in connection with one another by heat-pressing a single one piece of a resin film.

Referring to FIG. 6, the edge damper 106 is attached on the plate 103 by connecting its outer edge to an annular projection 103*a* formed on the plate 103, in a manner such that it can elastically support the vibrating diaphragm 104 and the coil holder 105, enabling the coil holder 105 to be floatingly supported within the annular magnetic gap of the magnetic circuit.

The coil holder 105 contains a voice coil 107 formed by winding a wire into a cylindrical configuration. Such a voice coil 107 is fixed within the coil holder 105 by means of an adhesive 108.

In this way, the voice coil 107 together with the coil holder 105 are allowed to be floatingly supported within the magnetic gap of the magnetic circuit, by means of the edge damper 106. The two ends of the voice coil 107 are respectively let out of the magnetic circuit, so as to be connected to a positive terminal (not shown) and a negative terminal (not shown).

A frame cover 109, which is formed by either a metal or a resin, is provided above the coil holder 105 and the edge damper 106, so as to protect them from a possible damage which will otherwise be caused by an impact from the outside. Further, the frame cover 109 is formed with a plurality of through holes 109*a* which are used to adjust a reproducing frequency of a sound output emitted from the vibrating diaphragm 104.

With the voice coil 107 fixed within the voice holder 105, and with the outer edge portion of the edge damper 106 connected to the projection 103*a* of the plate 103, the vibrating diaphragm 104, the coil holder 105, the voice coil 107, the edge damper 106, may be easily and correctly positioned with respect to the magnetic circuit.

Since a dome speaker is compact in size and easy to be assembled, it has been used as a receiver in a portable telephone. Further, since there has been a demand for a more compact portable telephone having a smaller thickness, a dome speaker for use in such portable telephone is also required to be made more compact in size and thinner in its thickness.

However, in order to manufacture a dome speaker with a small thickness, it is necessary that the height of a generally spherical diaphragm be reduced, since such height has a direct effect on the thickness of a dome speaker. This, however, results in a vibrating diagram having a generally elliptical and spherical shape. Since such a vibrating diaphragm does not have a sufficient strength, a deflection will occur in the diaphragm when reproducing an audio signal having a high frequency.

Further, when assembling a dome speaker, since the voice coil 107 is fixed in the coil holder 105 by means of an adhesive 108, the voice coil 107 and the coil holder 105 can not be moved until the adhesive 108 is cured, thus making it difficult for the assembling operation to quickly shift to a next step. As a result, it is difficult to obtain a high efficiency for the assembling operation for assembling a dome speaker.

SUMMARY OF THE INVENTION

It is an object of the present invention to provide an improved dome speaker which is easy to be assembled and whose vibrating diaphragm has a low height but ensures a sufficient strength, thereby allowing the speaker as a whole to be made with a small thickness, so as to solve the above-mentioned problems peculiar to the above-mentioned prior arts.

According to the present invention, there is provided a dome speaker comprising: a dome section including a vibrating diaphragm having a dome shape; an annular edge damper section provided surrounding the dome section; an annular coil holder provided between the dome section and the annular edge damper section for holding a voice coil. In particular, the dome section further includes a cap having substantially the same shape as the vibrating diaphragm, said cap being bonded on the said vibrating diaphragm.

In one aspect of the present invention, the cap has an annular stopper portion formed adjacent to the outer circumference thereof, so as to prevent the voice coil from moving out of the coil holder.

In another aspect of the present invention, an annular outer edge portion of the cap extends to an annular position so as to completely cover up the annular coil holder.

In a further aspect of the present invention, the dome-shaped vibrating diaphragm, the annular edge damper section, the annular coil holder are integrally formed in connection with one another, from a single one piece of a resin film.

In a still further aspect of the present invention, the cap is made of a material having a higher specific gravity and a higher Young's modulus than the above resin film.

According to the present invention, there is also provided a method of manufacturing a dome speaker, said method comprising the steps of: forming the vibrating diaphragm, the annular edge damper section and the annular coil holder, by heat-pressing a single one piece of a resin film; placing the voice coil into the annular coil holder and pouring a predetermined amount of an adhesive into the annular coil holder for fixing the voice coil in the coil holder; and bonding a cap on to the vibrating diaphragm.

The above objects and features of the present invention will become better understood from the following description with reference to the accompanying drawings.

DETAILED DESCRIPTION OF THE PREFERRED EMBODIMENTS

Figure 1:
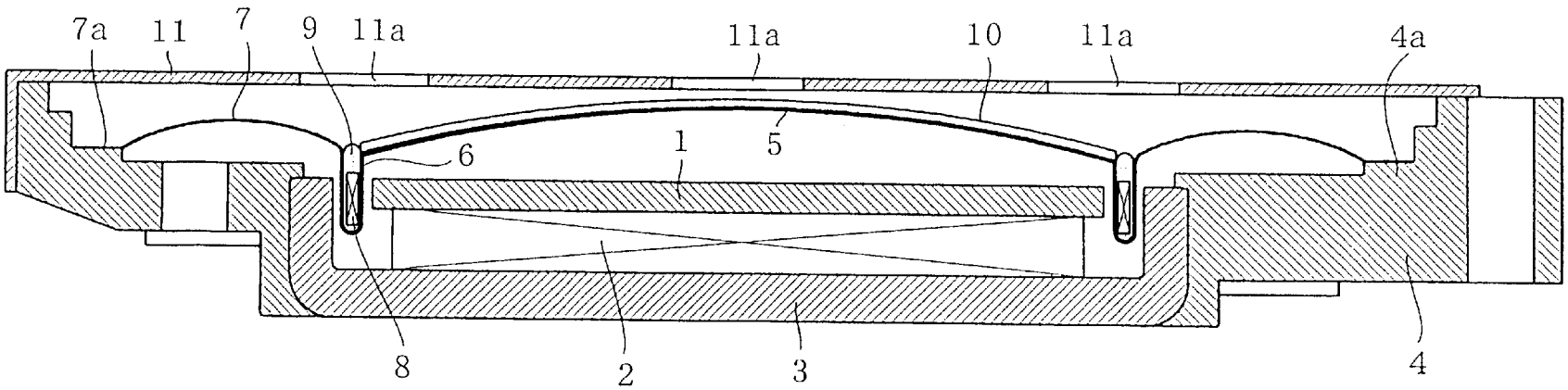
FIG. 1 is a cross sectional view schematically illustrating a dome speaker made according to the present invention.

Referring to FIG. 1 showing an embodiment of the present invention, a dome speaker comprises a pole plate 1, a magnet 2 and a yoke 3, all of them together constituting a magnetic circuit with an annular magnetic gap formed in a predetermined position. The magnetic gap is an annular space formed between the side surface of the pole plate 1 and the yoke 3. Further, a frame 4 made of a resin is provided on the outside of the yoke 3. Such frame 4, together with the magnetic circuit, forms a frame assembly.

Above, the pole plate 1 of the magnetic circuit is provided a vibrating diaphragm 5 having a generally elliptical spherical shape.

Figure 2:
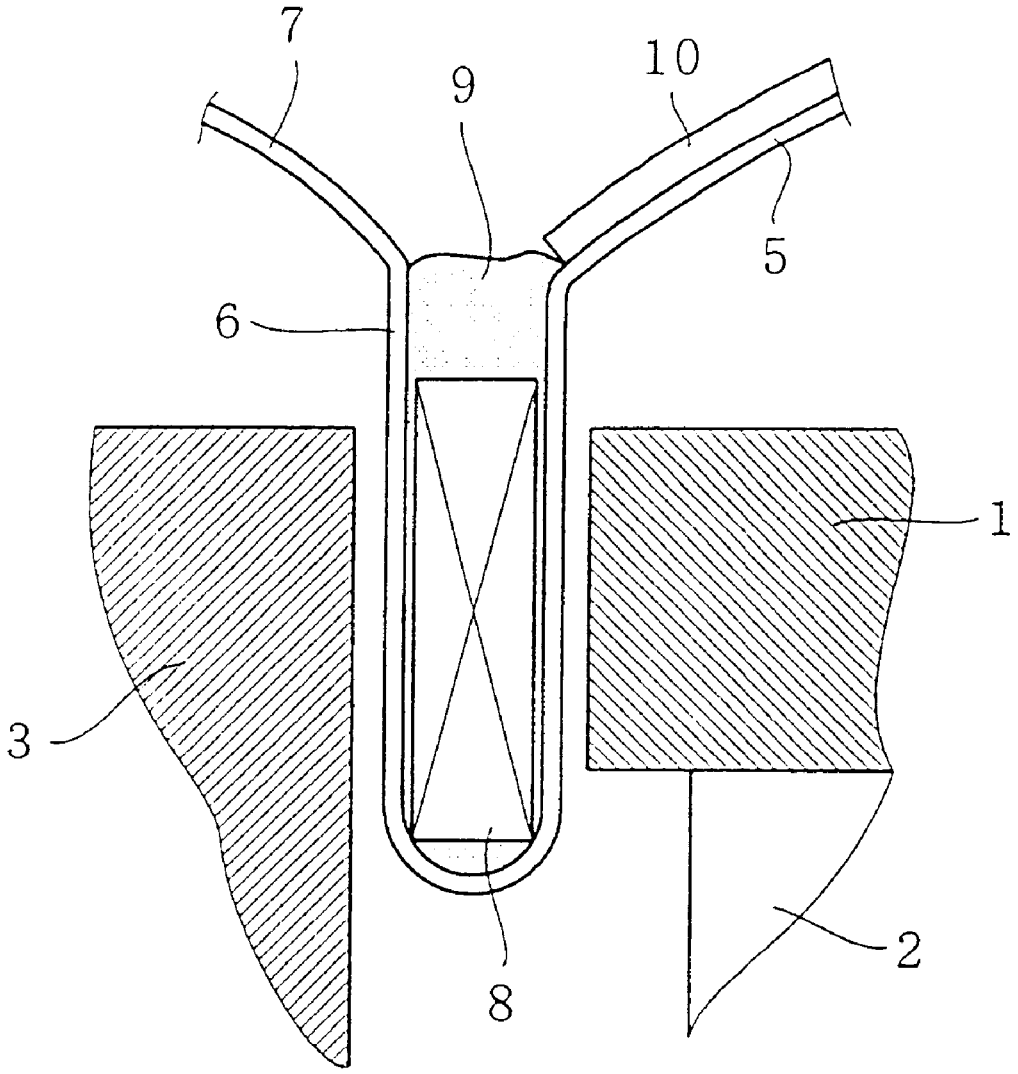
FIG. 2 is an enlarged cross sectional view schematically illustrating an area close to an outer edge of a dome-shaped vibrating diaphragm of the dome speaker shown in FIG. 1.
Figure 3A:
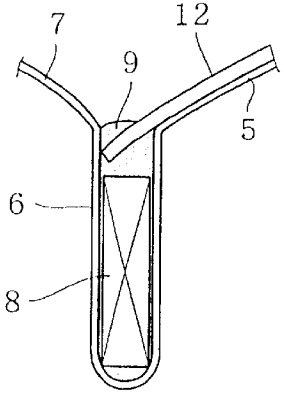
FIGS. 3A–3F are explanatory views schematically illustrating various examples of a vibrating assembly in which an outer edge of a cap is formed to cover up a coil holder.
Figure 3B:
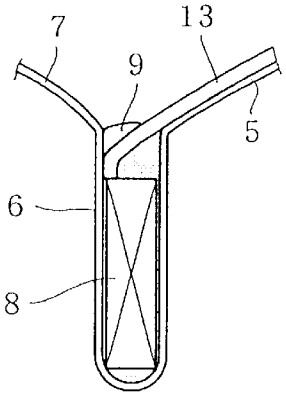
Figure 3C:
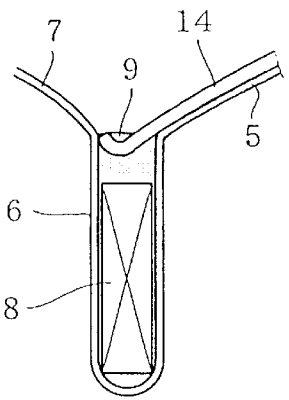
Figure 3D:
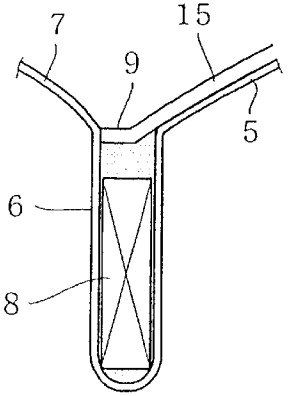
Figure 3E:
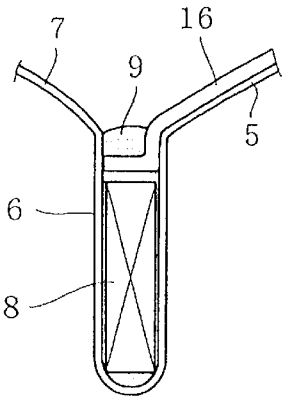
Figure 3F:
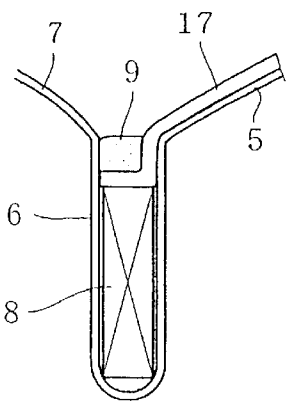
Figure 4A:
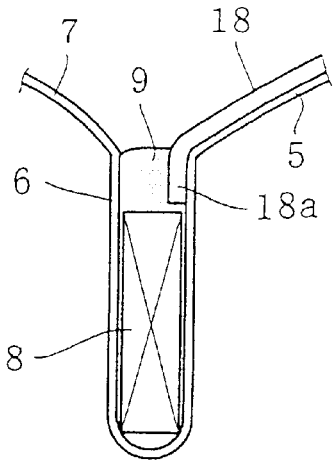
FIGS. 4A–4D are explanatory views schematically illustrating various examples of a vibrating assembly in which a cap is formed with an annular stopper portion for preventing a voice coil from moving out of a coil holder.
Figure 4B:
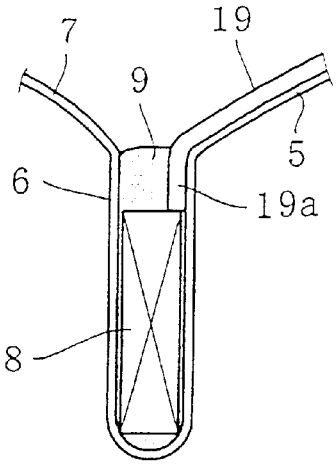
Figure 4C:
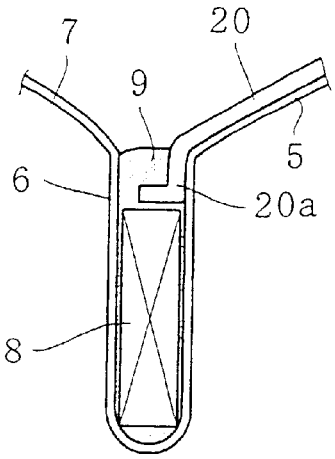
Figure 4D:
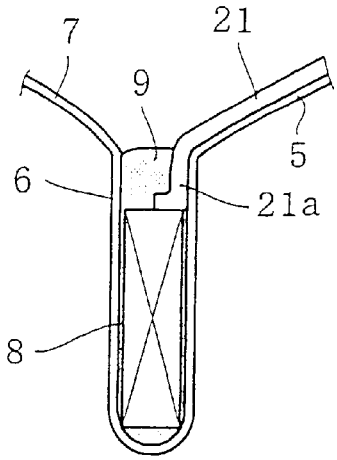

FIG. 2 is an enlarged view showing an area close to the outer edge of the vibrating diaphragm 5. As shown in FIG. 2, an annular coil holder 6 having a U-shaped cross section is provided adjacent to the outer edge of the vibrating diaphragm 5, an annular edge damper 7 is provided adjacent to the outer edge of the coil holder 6. Further, as shown in FIG. 1, adjacent to the outer edge of the edge damper 7 is provided an annular edge damper frame 7*a* having a horizontal surface. In practice, the edge damper 7 and the edge damper frame 7*a* together form an edge damper section.

In fact, the vibrating diaphragm 5, the annular coil holder 6, the annular edge damper 7, the edge damper frame 7*a,* are different parts of an integral diaphragm which may be obtained by heat-pressing one single piece of a resin film. A material for the resin film may be polyimide, polyphenyline sulfide, aramid film, which, once formed into a resin film, will not deform even under a condition of 100° C., thus enabling the speaker to produce a sound with a stabilized quality.

The annular edge damper frame 7*a* of the edge damper 7 is fixed on a shouldered portion of the frame 4, in a manner such that the edge damper 7 may elastically support both the vibrating diaphragm 5 and the coil holder 6. In this way, the coil holder 6 may be easily and correctly positioned within the magnetic gap.

The coil holder 6 contains a voice coil 8 which is fixed within the holder by means of an adhesive 9. Said voice coil 8 may be obtained by circularly winding a wire into a cylindrical configuration.

In this way, with the use of the edge damper 7, the voice coil 8 together with the coil holder 6 are allowed to be positioned and floatingly supported within the magnetic gap of the magnetic circuit. Both ends of the wire forming the voice coil 8 are let out of the magnetic circuit to be connected, directly or through a lead wire, to a positive terminal and a negative terminal, respectively.

Referring again to FIGS. 1 and 2, a cap 10 is bonded over the entire surface of the vibrating diaphragm 5. In more detail, the cap 10 is formed to have almost the same shape as the vibrating diaphragm 5, such that it may be bonded on to the vibrating diaphragm 5 by virtue of an adhesive 9, without causing any deformation of the vibrating diaphragm 5. A material for forming the cap 10 should have a higher specific gravity and a higher Young's modulus than a material for forming the vibrating diaphragm 5. For example, it is preferred to use a light metal such as aluminium or titanium to form the cap 10.

Further, as shown in FIG. 1, a top cover 11, which is formed by a metal or a resin, is fixed on the frame 4 so as to cover the vibrating diaphragm 5, the cap 10, the coil holder 6 and the edge damper 7, in order to protect these elements from a possible damage which will probably be caused due to an outside impact. In addition, the top cover 11 is formed with a plurality of through holes 11*a* for smoothly emitting sound from the speak to the outside environment.

In use, when an audio signal in the form of an electric current is applied to the dome speaker through its positive and negative terminals, the voice coil 8 located within the magnetic gap will receive a driving force corresponding to the audio signal. Thus, the vibrating diaphragm 5 bonded with the cap 10 is caused to vibrate, so as to produce a corresponding sound which will be emitted to the outside of the speaker through the holes 11*a*.

A method of manufacturing a dome speaker shown in FIG. 1 will be described in detail below.

At first, a frame assembly and a diaphragm member are formed in advance.

The diaphragm member is formed by heat-pressing a piece of a resin film, with the use of a metal mold capable of forming the vibrating diaphragm 5, the coil holder 6, the edge damper 7, and the edge damper frame 7*a*. The diameter of the diaphragm member should be set so that its outer edge may be coincident with a shouldered portion of the frame 4.

The diaphragm member thus formed is temporarily fixed on a jig, and a voice coil 8 is moved into the coil holder 6. Meanwhile, a predetermined amount of an adhesive is poured into the coil holder 6 so as to fix the voice coil 8 in the coil holder 6.

Then, the cap 10 is tightly bonded on to the entire surface of the vibrating diaphragm 5 with the use of an adhesive 9. At this moment, since the cap 10 has a shape which is almost the same as the vibrating diaphragm 5, it is easy for the cap 10 to be correctly positioned on the vibrating diaphragm 5 by simply mounting the former on the later.

In this way, a vibrating assembly including the diaphragm member, the voice coil 8 and the cap 10, is thus obtained.

Afterwards, the edge damper frame 7*a* of the edge damper 7 is bonded to the shouldered portion 4*a* of the frame 4, thereby fixing the vibrating assembly on the predetermined position of the frame assembly.

In this manner, the vibrating assembly including the cap 10, the vibrating diaphragm 5, the coil holder 6, the voice coil 8 and the edge damper 7, may be positioned correctly on the frame assembly with a high precision.

Finally, after the top cover 11 is attached on the frame 4, a dome speaker is thus formed.

In use of the dome speaker made in the above process, since the cap 10 has a higher specific gravity and a higher Young's modulus than the vibrating diaphragm 5, the combination of such cap 10 with the vibrating diaphragm 5 enables the vibrating diaphragm 5 to have an improved strength, thereby effectively prohibiting a possible deflection of the vibrating diaphragm 5 when it is driven for reproducing an audio signal having a high frequency.

Further, since the mass of the cap is possible to be selected, it is easy to adjust an equivalent mass of the vibrating assembly, allowing the dome speaker to obtain a desired low frequency characteristic.

Although it has been explained in the above that the cap 10 has almost the same shape (generally elliptical spherical shape) as the vibrating diaphragm 5, i.e., has almost the same diameter as the vibrating diaphragm 5, it is also possible that the cap 10 may have a larger diameter than that of the vibrating diaphragm 5 so that its outer edge is allowed to extend to cover up the coil holder 6.

FIGS. 3A–3F are explanatory views indicating various examples where a cap has a larger diameter than that of the vibrating diaphragm 5 so that its outer edge is allowed to cover up the coil holder 6.

As shown in FIGS. 3A–3F, since a cap (represented by any one of reference numerals 12–17) has a larger diameter than that of the vibrating diaphragm 5, its outer edge serves as a stopper portion which is allowed to cover up the coil holder 6, so that the voice coil 8 may be prevented from moving out of the coil holder 6. Therefore, a process for assembling the dome speaker is allowed to shift to a next step even if the adhesive agent 9 for fixing the voice coil 8 in the coil holder 6 has not been solidified.

Further, although it has been shown in the examples of FIGS. 3A–3F that a cap (12–17) has a larger diameter than that of the vibrating diaphragm 5 so that its outer edge completely covers up the coil holder 6, it is also possible that a cap (12–17) may have a smaller diameter than that in the examples of FIGS. 3A–3F and thus the cap's outer edge only partially covers the coil holder 6, provided that the voice coil 8 may be prevented from jumping out.

FIGS. 4A–4D are explanatory views indicating various examples where a cap (18,19,20 or 21) has a smaller diameter than that in the examples of FIGS. 3A–3F, but is formed with a stopper (18*a*,19*a*,20*a* or 21*a*). As shown in FIGS. 4A–4D, although a cap can only partially cover the coil holder 6, the voice coil 8 may still be prevented from moving out of the coil holder 6, due to an effect of a stopper.

Figure 5:
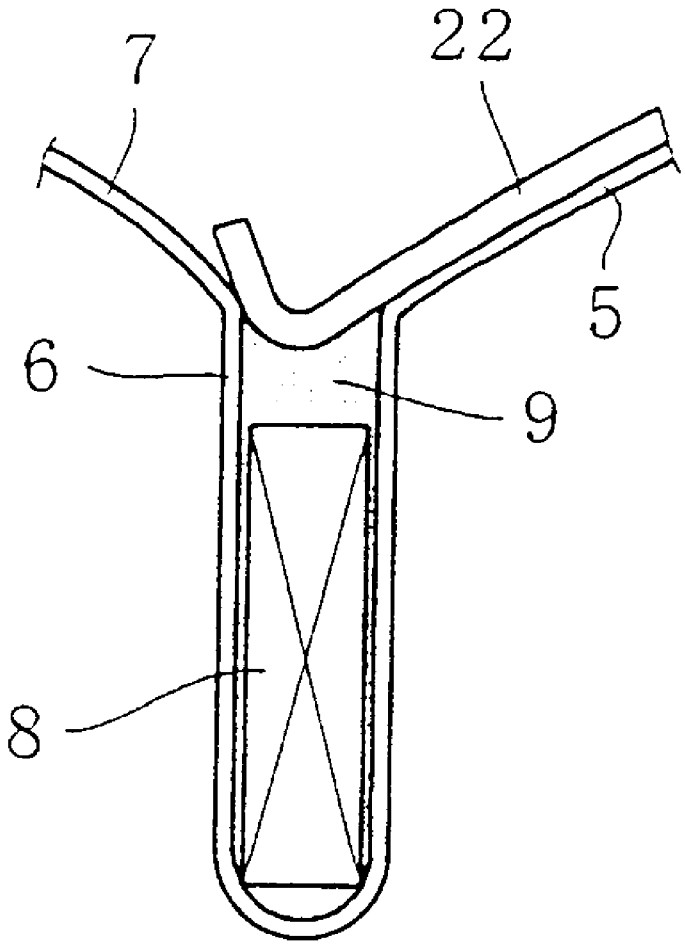
FIG. 5 is an explanatory view schematically illustrating a further example of a vibrating assembly in which the cap is formed with an annular stopper portion for preventing a voice coil from moving out of a coil holder.
Figure 6:
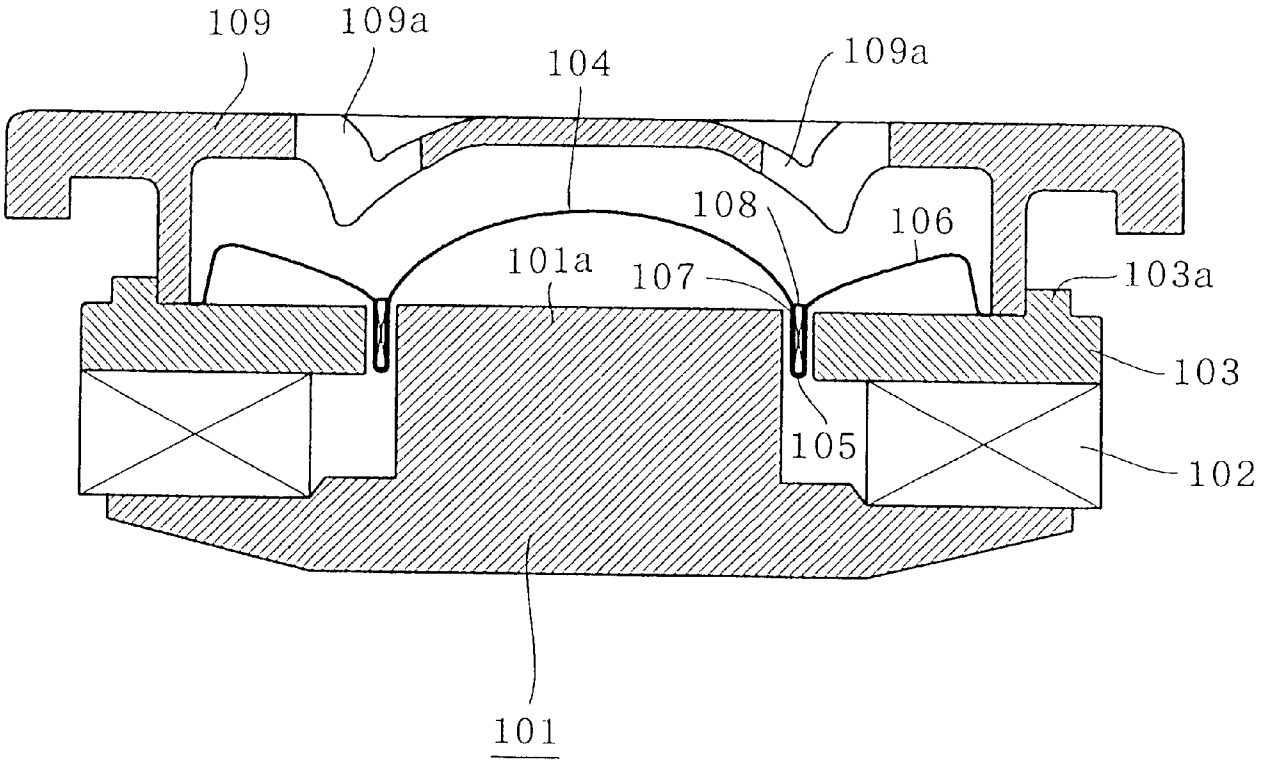
FIG.6 PRIOR ART
FIG. 6 is a cross sectional view schematically illustrating a dome speaker made according to a prior art.
Figure 7:
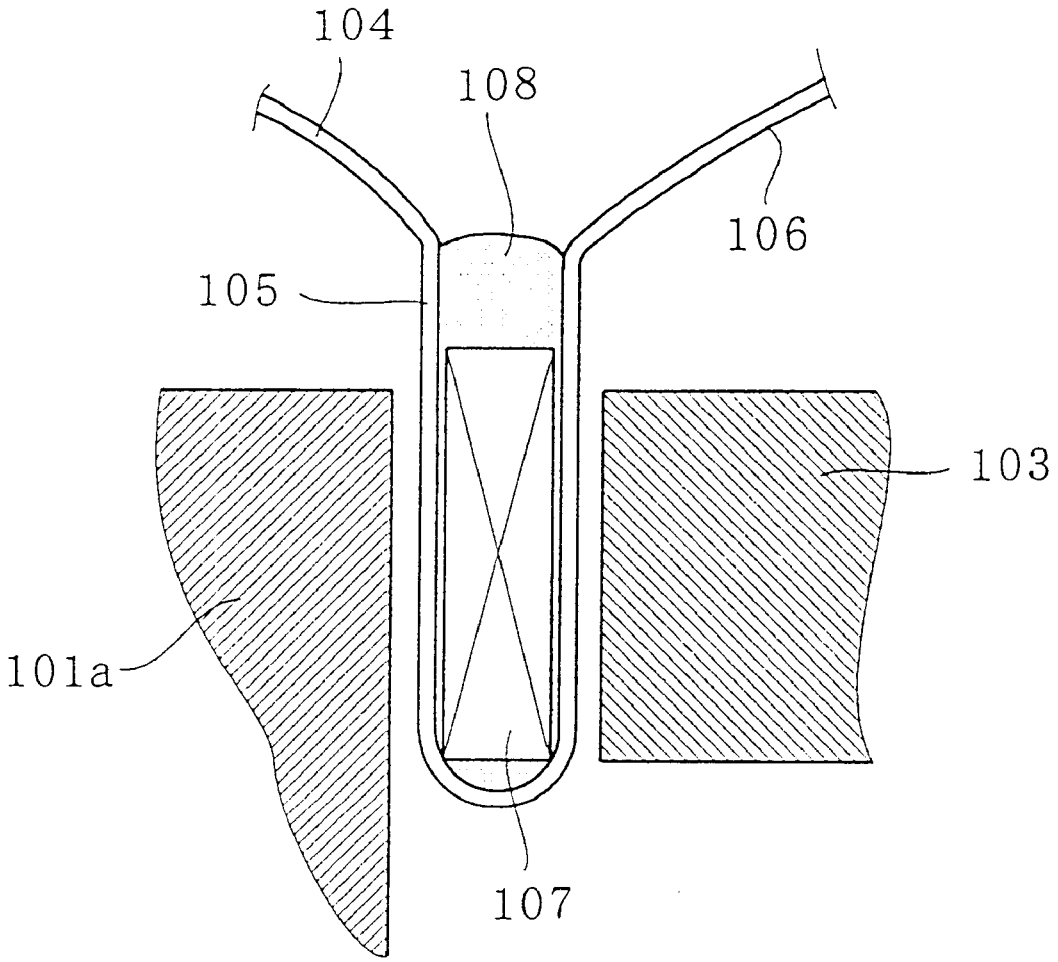
FIG.7 PRIOR ART
FIG. 7 is an enlarged cross sectional view schematically illustrating an area close to an outer edge of a dome-shaped vibrating diaphragm of the dome speaker shown in FIG. 6.

FIG. 5 is an explanatory view indicating a further example of a cap bonded to a vibrating diaphragm in a dome speaker. As shown in FIG. 5, the cap 22 is formed to be larger than the outer circumference of the coil holder 6, thereby ensuring that the voice coil 8 may be exactly prevented from slipping out of the coil holder 6 and that the adhesive agent 9 for fixing the voice coil 8 in the coil holder 6 may be exactly prevented from spilling out to the edge damper 7.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. A dome speaker comprising:

a dome section including a vibrating diaphragm having a dome shape;

an annular edge damper section provided surrounding the dome section;

an annular coil holder provided between the dome section and the annular edge damper section for holding a voice coil;

wherein the dome section further includes a cap having substantially the same shape as the vibrating diaphragm, said cap being bonded on the said vibrating diaphragm, and wherein the cap has an annular stopper portion formed adjacent to the outer circumference thereof, so as to prevent the voice coil from moving out of the coil holder.

2. The dome speaker according to claim 1, wherein an annular outer edge portion of the cap extends to an annular position so as to completely cover up the annular coil holder.

3. The dome speaker according to claim 1, wherein the dome-shaped vibrating diaphragm, the annular edge damper section, the annular coil holder are integrally formed in connection with one another, from a single one piece of a resin film.

4. The dome speaker according to claim 3, wherein the cap is made of a material having a higher specific gravity and a higher Young's modulus than the above resin film.

5. A dome speaker comprising:

a dome section including a vibrating diaphragm having a dome shape;

an annular edge damper section provided surrounding the dome section;

an annular coil holder provided between the some section and the annular edge damper section for holding a voice coil;

wherein the dome section further includes a cap having substantially the same shape as the vibrating diaphragm, said cap being bonded on the said vibrating diaphragm, wherein the edge damper section is integrally formed with the annular coil holder and the vibrating diaphragm, and has an inverted slightly U-shaped cross section so that the voice coil is allowed to easily drop into the annular coil holder, wherein the cap has an annular stopper portion formed adjacent to the outer circumference thereof, so as to prevent the voice coil from moving out of the coil holder.

6. The dome speaker according to claim 5, wherein an annular outer edge portion of the cap extends to an annular position so as to completely cover up the annular coil holder.

7. The dome speaker according to claim 5, wherein the dome-shaped vibrating diaphragm, the annular edge damper section, the annular coil holder are integrally formed in connection with one another, from a single one piece of a resin film.

8. The dome speaker according to claim 7, wherein the cap is made of a material having a higher specific gravity and a higher Young's modulus than the above resin film.

* * * * *